US005431548A

United States Patent [19]

Koble, Jr.

[11] Patent Number: 5,431,548

[45] Date of Patent: Jul. 11, 1995

[54] SINGLE SUCTION INLET EVAPORATIVE COOLER PUMP APPARATUS

[76] Inventor: Robert L. Koble, Jr., HC 50, 138, Camp Verde, Ariz. 86322

[21] Appl. No.: 89,499

[22] Filed: Jul. 12, 1993

[51] Int. Cl.[6] ..... F04D 29/10

[52] U.S. Cl. ..... 417/423.8; 417/423.11; 415/230

[58] Field of Search ..... 417/423.1, 423.3, 423.9, 417/423.8, 423.11, 423.14, 424.1; 415/230; 384/138

[56] References Cited

U.S. PATENT DOCUMENTS

| | | | |
|---|---|---|---|
| 2,598,484 | 5/1952 | Adams | 417/423.11 |
| 3,397,644 | 8/1968 | Einerson et al. | 415/176 |
| 3,408,942 | 11/1968 | Davenport et al. | 417/423.14 |
| 3,748,066 | 7/1973 | Sully et al. | 417/423.3 |
| 3,806,975 | 4/1974 | Fyfe | 14/16 |
| 4,856,971 | 8/1989 | Koble | 417/423.8 |
| 4,882,806 | 11/1989 | Davis | 16/198 |
| 5,055,006 | 10/1991 | Kobayashi et al. | 417/423.3 |
| 5,061,157 | 10/1991 | Arakawa | 417/423.3 |
| 5,205,725 | 4/1993 | Pattison | 417/423.3 |

*Primary Examiner*—Richard A. Bertsch
*Assistant Examiner*—Peter Korytnyk
*Attorney, Agent, or Firm*—H. Gordon Shields

[57] ABSTRACT

Pump apparatus for an evaporative cooler includes an impeller housing sealed on its top wall by a closed cell foam element and a bearing and seal element. The impeller housing has only one water inlet and one water outlet. The sealing of the impeller housing allows the level of the water in which the pump is disposed to be substantially lower than with prior art pumps, and substantially eliminates air intake into the impeller housing except through the one water inlet. Water outflow is only through the impeller housing outlet. Two embodiments are illustrated.

30 Claims, 2 Drawing Sheets

SINGLE SUCTION INLET EVAPORATIVE COOLER PUMP APPARATUS

BACKGROUND OF THE INVENTION

1. Field of the Invention

This invention relates to evaporative cooler pumps and, more particularly, to a single suction inlet evaporative cooler pump having a bearing seal and seal elements for the impeller housing of the evaporative cooler pump where the motor shaft extends into the impeller housing.

2. Description of the Prior Art

Evaporative cooler pumps have an impeller housing at the bottom of the pump and a motor at the top of the pump. Extending between the motor and an impeller in the impeller housing is a relatively long motor shaft. The shaft extends into the impeller housing through a relatively large diameter hole or aperture in the top of the housing. The primary reason that the hole or aperture in the top of the housing is relatively large is for convenience in the assembly of the motor to the pump housing. That is, the location of the motor or impeller shaft with respect to the hole or aperture may vary, depending on the type of motor used, the manner in which the motor is secured to the housing, and other variables. Thence the need for a hole that is substantially larger than the shaft diameter.

A secondary reason for a relatively large hole is that an eccentric motion of the shaft is not uncommon. Accordingly, a relatively large diameter hole or aperture is generally required. This relatively large diameter hole is an integral element in each evaporative cooler pump.

One of the inherent limitations of evaporative cooler pumps due to the hole in the top of the impeller housing is the necessity of a relatively high water level in the pan of the evaporative cooler. If the water level drops too close to the top of the impeller housing, the presence of the hole through the top of the impeller housing causes air to be sucked into the impeller housing, and there is a corresponding loss of efficiency of the pump itself.

Another inherent limitation of evaporative cooler pumps, or an inherent problem with them, due to the relatively large hole, is the upward slinging or rise of water or water particles along the shaft and to the pump motor. This results in rust and corrosion problems and in the eventual premature failure of the motor.

If the impeller shaft were sealed at the housing, the water level could be lowered by a substantial amount, like about an inch or so, without having any effect on the efficiency of the pump itself. The water level could then be almost as low as the water inlet at the bottom of the pump housing, that is, below the top of the impeller housing. Moreover, the upward movement of water particles along the shaft to the motor is substantially prevented.

While there has thus been a need to provide a seal for the shaft at the impeller housing, no such element has been successfully developed in the prior art. Any such seal would have to provide a dual function, a seal would have to be provided and a bearing seal for the shaft would have to be provided. In addition, the seal would have to be sufficiently flexible to compensate for eccentric shaft movements, and the like.

The apparatus of the present invention overcomes the deficiencies of the prior art and provides a seal for the impeller housing and a bearing seal for the impeller shaft.

SUMMARY OF THE INVENTION

The invention described and claimed herein comprises an evaporative cooler pump having a single inlet impeller housing with a closed cell foam seal element and a seal and bearing element on the top of the impeller housing and through which an impeller shaft extends. The seal and bearing element is disposed on top of the closed cell foam seal. The closed cell foam seal element is disposed against the top of the impeller housing to provide a seal for the impeller housing. The bearing and seal element is movable and it also seals the motor shaft. The seal and bearing elements are not fixed in place, but rather are able to move to accommodate flexure and eccentric movement of the impeller shaft.

Among the objects of the present invention is the following:

To provide new and useful evaporative cooler pump apparatus;

To provide new and useful evaporative cooler pump apparatus having a single suction inlet;

To provide new and useful seal apparatus for sealing a top aperture in an impeller housing in an evaporative cooler pump;

To provide new and useful bearing seal apparatus for a rotating impeller shaft in an evaporative cooler pump;

To provide new and useful evaporative cooler pump apparatus using closed cell foam or the like as a flexible sealing element for sealing the impeller housing;

To provide new and useful relatively solid bearing and seal element disposed on a flexible seal for sealing a hole in the top of an impeller housing of an evaporative cooler pump; and To provide new and useful bearing and seal apparatus for an impeller shaft of a motor in an evaporative cooler pump and a seal and bearing element for sealing the hole or aperture in an impeller housing through which the impeller shaft of a motor extends.

DESCRIPTION OF THE PREFERRED EMBODIMENT

Figure 1:
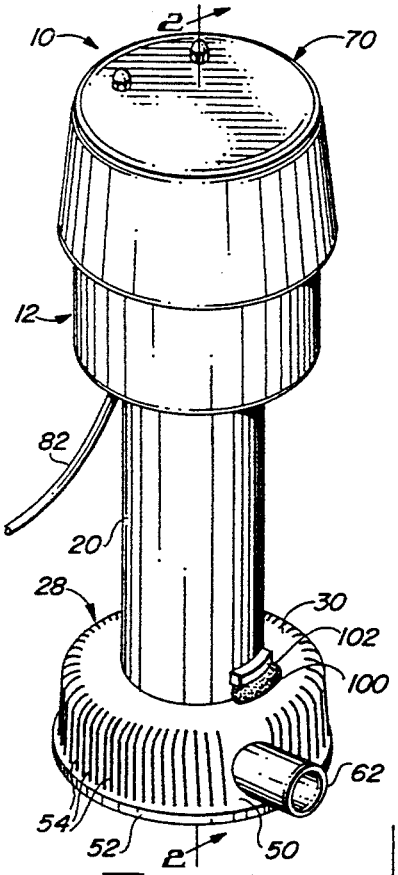
FIG. 1 is a perspective view of an evaporative cooler pump including the apparatus of the present invention.

FIG. 1 is a perspective view of a single inlet evaporative cooler pump apparatus 10 embodying the present invention.

Figure 2:
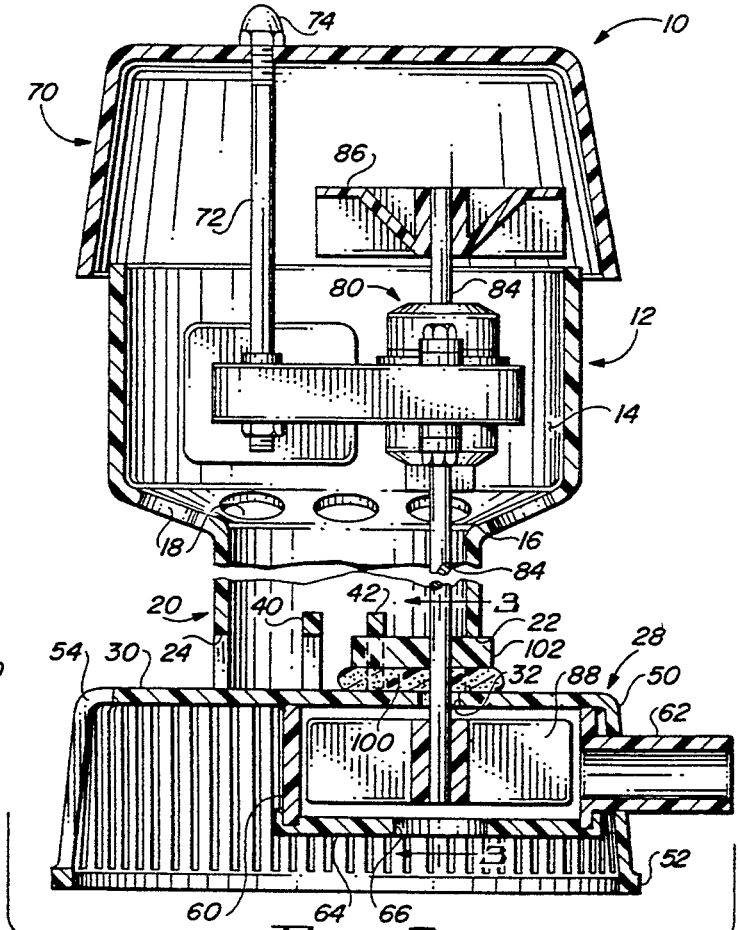
FIG. 2 is a view in partial section taken generally along line 2—2 of FIG. 1.

FIG. 2 is a view in partial section taken generally along line 2—2 of the pump apparatus 10 of FIG. 1. FIG. 2 is enlarged and shows details of the pump apparatus 10.

The pump apparatus 10 includes an upper generally cylindrical motor housing 12 in which there is a motor chamber 14. A motor 80 is disposed within the motor chamber 14 of the motor housing 12. The pump apparatus 10 also includes a generally cylindrical middle or shaft housing portion 20, and a lower or bottom housing or water intake portion 28 beneath the middle housing 20.

The lower housing portion 28 includes a horizontal wall 30, an outwardly extending sloping support wall 50 extending generally downwardly from the outer periphery of the horizontal wall 30, and a rim 52 on the bottom of the wall 50. An impeller housing 60 is disposed within the lower housing portion 28. The support wall 50 provides support for the pump itself, or for the various housing portions and the motor and associated elements. In the use environment, the rim 52 of the wall 50 is disposed on the bottom or pan of an evaporative cooler (not shown).

Figure 3:
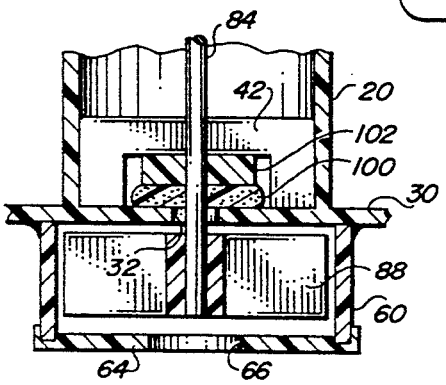
FIG. 3 is a view in partial section taken generally along line 3—3 of FIG. 2.
Figure 4:
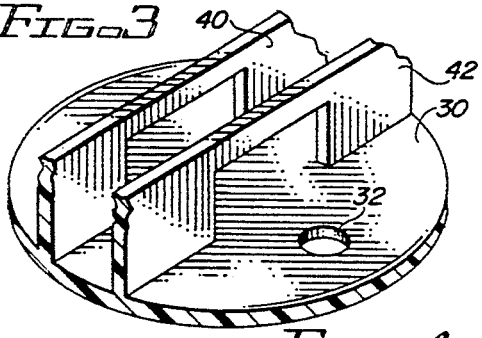
FIG. 4 is a perspective view of a portion of the apparatus of the present invention.

FIG. 3 is a view in partial section taken generally along line 3—3 of FIG. 2, illustrating details of the apparatus of the present invention. FIG. 4 is a perspective view of the horizontal wall 30, illustrating details of its construction. For the following discussion of the pump apparatus 10, reference will be made to FIGS. 1, 2, 3, and 4.

The upper, motor housing 12, as indicated above, is generally cylindrically configured. A pump motor 80 is disposed in the motor chamber 14 within the housing 12. The cylindrical motor chamber 14 will receive both circular (round) motors or offset, C-frame motors, as desired. In FIG. 2, the motor 80 is illustrated as an offset, C-frame motor.

At the bottom of the upper housing 12 is a bottom tapering wall 16. The wall 16 tapers generally inwardly and downwardly to the middle or shaft housing 20. A plurality of vent apertures 18 extend through the tapering wall 16.

The middle housing 20 extends from the wall 16 of the upper housing to the horizontal wall 30 of the bottom or lower housing 28 and may have any appropriate configuration. The middle housing 20 comprises a housing for a motor shaft 84.

Figure 6:
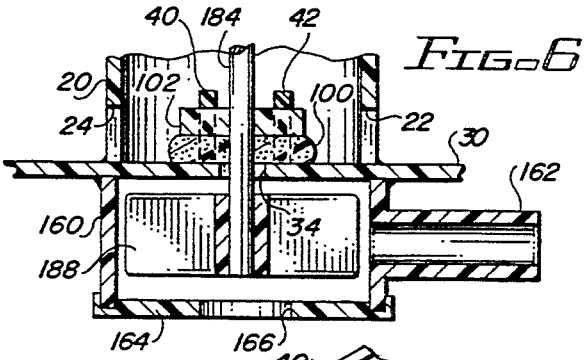
FIG. 6 is a view in partial section illustrating the use environment of the apparatus of FIG. 5.
Figure 5:
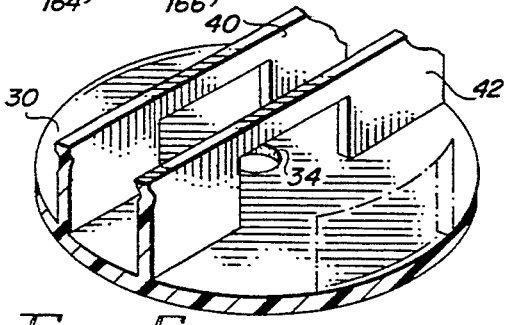
FIG. 5 is a perspective view of an alternate embodiment of the apparatus of FIG. 4.

As best illustrated in FIG. 2, the diameter of the horizontal wall 30 is slightly greater than the diameter of the upper, or motor, housing 12, and substantially greater than the diameter of the middle, or shaft, housing 20. The horizontal wall 30 includes either of two apertures, an offset aperture 32 or a central aperture 34, as shown in FIGS. 5 and 6. Thus, the pump apparatus 10 may be used for either a round motor (not shown) or an offset or C-frame motor, such as the motor 80. If a round motor were used, its shaft would extend through the central aperture 34, as shown in FIG. 6. Since the offset motor 80 is being used in the pump apparatus 10 of FIGS. 1, 2, 3, and 4, the central aperture 34 is closed or eliminated. The offset aperture 32 receives the drive or impeller shaft 84 of the motor 80.

Extending through the middle, or shaft housing 20 is a pair of apertures 22 and 24. The apertures 22 and 24 extend upwardly from the horizontal wall 30. Aligned with the apertures 22 and 24 is a pair of locking arches or bridges 40 and 42. The arches 40 and 42 extend upwardly from the wall 30 and across the housing 20. The locking arches 40 and 42 are aligned with the apertures 32 and 34 in the wall 30 and with the aperture 22 and 24 in the shaft housing 20. That is, the apertures 22 and 24, the arches 40 and 42, and the apertures 32 and 34 are aligned for purposes which will be discussed in detail below and which are illustrated in FIGS. 2, 3, 4, 5, and 6.

Extending downwardly from the outer periphery of the wall 30 is the slanted or sloping bottom support wall 50. The support wall 50 is coaxially aligned with the middle housing portion 20 and the upper housing portion 12. The sloping bottom wall 50 terminates in the circular rim 52. A plurality of strainer slots 54 extend vertically through the bottom wall 50. The upper portions of the slots 54 extend slightly into the outer periphery of the horizontal wall 30. This is shown in FIGS. 1 and 2.

The strainer slots 54 serve to prevent debris from entering into the bottom portion of the pump apparatus 10. Thus, exterior strainer elements, such as strainer baskets, are obviated by the integral strainer elements, namely the slots 54, for the pump apparatus 10.

Within the bottom housing portion 28, and extending downwardly from the wall 30, is an impeller housing wall 60. The impeller housing wall 60 comprises a circular wall which is generally coaxially aligned with the aperture 32. Extending outwardly from the wall 60 is an outlet 62. The outlet 62 extends outwardly through the wall 50 of the bottom housing portion 28. Water flows out of the impeller housing wall 60 through the outlet 62.

The impeller housing wall 60 is closed by a bottom wall 64. The wall 64 is appropriately secured to the bottom of the housing wall 60.

The housing wall 60 comprises a side wall for a chamber in which a pump impeller is disposed. The wall 30 comprises a top wall for the chamber, and the wall 64 comprises a bottom wall for the chamber. Thus, essentially, the impeller housing includes a portion of the wall 30, the wall 60, and the bottom wall 64.

A single suction water intake aperture 66 extends through the bottom 64. Water in which the pump apparatus 10 is disposed flows into the lower portion 28 of the pump apparatus 10 through the strainer slots 54 and into the impeller housing 60 through the single water intake aperture 66. Water flows out of the impeller housing 60 through the outlet 62. The slots 54 help prevent debris from flowing into the impeller housing.

The offset motor 80 includes a power cord 82 (See FIG. 1) which extends outwardly from the pump apparatus 10 and is connected to an appropriate source of electrical power.

The motor 80 is appropriately secured within the upper portion of motor chamber 14 of the motor housing 12, as is well known and understood in the art.

The shaft 84 of the motor 80 extends downwardly from the motor 80 within the motor chamber 14 of the motor housing 12, and downwardly through the middle or shaft housing portion 20, through the aperture 32 in the horizontal wall 30, and into the impeller housing 60. An impeller 88 is secured to the bottom portion of the shaft 84 within the impeller housing 60. Obviously, the bottom 64 is secured to the impeller housing 60 after the impeller 88 is secured to the shaft 84.

The shaft 84 also extends above the motor 80. A fan 86 is secured to the top of the shaft 84 above the motor 80.

A cap 70 is secured to the housing 12 at the wall 16 by a threaded shaft 72 and a top nut 74. The bottom of the shaft 72 is appropriately secured to the wall 16.

Cooling air is brought into the upper portion of the housing 12 through the apertures 18 in the wall 16 by the fan 86. The cooling air flows upwardly in the chamber 14 and is circulated over the motor 80 and into the cap 70. The air then exits or flows out of the housing 12 and the cap 70 through the space between the lower portion of the cap 70 and the upper portion of the housing 12.

The cooling air is drawn into the housing 12 and upwardly in the cap 70 and is moved outwardly by the fan 86 as the shaft 84 rotates. At the same time, water is drawn into the impeller housing 60 through the slots 54 in the bottom housing 28 and through the aperture 66 in the bottom wall 64 by the impeller 88. The water drawn into the impeller housing 60 is pumped out of the impeller housing 60 through the outlet 62. The shaft 84 thus cools the motor 80 and pumps water at the same time.

As indicated above, the impeller housing 60 is sealed from above so that neither air nor water flows into the impeller housing 60 from above and water does not flow out of the housing 60 along the shaft 84. Again, as indicated above, the level of the water in which the pump 10 may be placed need only be high enough to cover the water inlet 66.

The sealing of the impeller housing from above is accomplished by two elements. The first element is a flexible seal 100 which is disposed above the aperture 32 on the wall 30 and about the shaft 84. The second is a movable seal and bearing element 102.

The seal 100 is preferably a flexible closed cell foam seal element. The closed cell foam seal element 100 extends between, and is accordingly held in place by, the aperture 22 in the shaft housing 20 and the arch 42. The arch 42, along with the arch 40, comprise retainer elements that are used to secure the seal elements 100 and 102 on the horizontal wall 30 and about the shaft 84.

The bearing and seal element 102 is disposed above the seal 100 and it also extends between the aperture 22 and the arch or retainer element 42. The bearing and seal element 102 also acts as a holding element to help hold the seal element 100 in place.

Neither the seal 100 nor the bearing and seal element 102 are permanently secured in place. Rather, both elements are free to move in accordance with the eccentricity of the motor of impeller shaft 84. That is, since the shaft 84 may move in an eccentric fashion as it rotates, the seal element 100 and the bearing element and seal 102 move with it, but the integrity of the seal between the shaft 84 and the bearing and seal element 102 is maintained. The aperture 32 of the impeller housing 60 is accordingly sealed by use of the two elements 100 and 102.

The seal element 100 is flexible in and of itself, and eccentric movements of the shaft 84 will be accommodated by the seal element 100 without destroying the integrity of the seal. The bearing and seal element 102 has a width which is less than the width of the retainer arches 40 and 42 (see FIG. 3) and of the apertures 22 and 24. This allows the bearing and seal element 102 to move, also, if necessary, in response to any eccentric movement of the shaft 84.

The bearing and seal element 102 is disposed on top of the seal element 100 to help retain the seal element in place. Obviously, the closed foam seal element 100 is more flexible than the bearing and seal element 102. A generally unyielding element, such as the bearing and seal element 102, may help to hold the closed cell foam seal element 100 in place, and provides a downward bias on the seal element 100 to help seal the aperture 32.

The bearing and seal element 102 is preferably a polytetrafluoroethylene block, or a block of some other appropriate type of bearing material, having an aperture extending through it to receive the shaft 84. The diameter of the aperture in the element 102 is of substantially the same size as the diameter of the shaft 84. The element 102 thus acts as a seal for the shaft and also as a bearing element for the shaft.

The element 102 is not flexible, but it is movable in that it is not fixedly constrained vertically or laterally or longitudinally. Since the element 102 is disposed on top of a flexible element, it can move vertically if necessary. Since the width of the element 102 is less than the width of the arches 40 and 42 and the aperture 22, the element 102 may move laterally. The element 102 is also able to move longitudinally in response to eccentric movement of the shaft 84.

The closed cell foam element 100 is flexible and it flexes in response to any eccentric movement of the shaft 84. The bottom element 100 includes an aperture extending through it for receiving the shaft 84. The bottom seal element 100 acts as a seal for the top element 102, as it were.

Thus, both elements 100 and 102 cooperate to seal the top of the impeller housing and the motor shaft extending through an aperture in the top of the impeller housing 60. Accordingly, there is only a single water inlet for the impeller housing, namely the aperture 66 extending through the bottom wall of the impeller housing.

FIG. 5 is a perspective view of the horizontal wall 30, with a central aperture 34 open, and without the offset aperture 32. That is, the aperture 32 is closed.

FIG. 6 is a view in partial section of an alternate embodiment of an impeller housing used in the pump apparatus 10, but used with the wall embodiment 30 of FIG. 5 and with a round motor. For the following discussion, reference will be made primarily to FIGS. 5 and 6.

When a round or symmetrical motor is used, then the central aperture 34 through the horizontal wall 30 will be employed, and the offset aperture 32 will be closed or sealed. In such case, the upper housing 12, and the middle housing 20 will generally remain as illustrated in FIGS. 2 and 3. A new impeller housing 160 may be employed rather than the impeller housing 60 illustrated in FIGS. 2 and 3. The impeller housing 160 is shown disposed coaxially about the aperture 34. The aperture 34 is coaxially aligned with the shaft or middle housing 20 and the wall 30.

The top of the horizontal wall 30 remains as illustrated in FIGS. 2, 3, and 4, and in other respects the upper, motor housing 12 similarly remains as illustrated. A symmetrical motor (not shown) includes an impeller or motor shaft 184 which extends downwardly generally coaxially aligned or disposed within the middle of the shaft housing 20. The impeller shaft 184 extends through the central aperture 34 and into the impeller housing 160. Within the impeller housing 160 is an impeller 188 at the bottom end of the shaft 184.

The impeller housing 160 includes an impeller outlet 162 through which water pumped by the impeller 188 flows out of the housing 160. The impeller housing 160 is closed at its bottom end by a bottom wall 164. A single water intake aperture or suction inlet 166 extends through the bottom wall 164. Obviously, the wall 164 is appropriately secured to the bottom of the impeller housing 160.

The aperture 34 about the shaft 184 is appropriately sealed by the closed cell foam sealing element 100, as with the pump apparatus 10, discussed above. Similarly, the bearing and seal element 102 is disposed above the seal 100. The shaft 184 extends through the seal 100 and the bearing and seal element 102, also as discussed above.

With the shaft 184 extending symmetrically and coaxially through the middle or shaft housing 20, the seal 100 and the bearing and seal element 102 are held in place over the aperture 34 and about the shaft 184 by both of the retainer arches or bridges 40 and 42. Since the arches 40 and 42 are disposed on opposite sides of the central aperture 34, they serve as retainers for the seal element 100 and the bearing and seal element 102. The aperture 22 which extends through the wall of the middle housing 20, is not needed as a support element for the seal 100 and the bearing and seal element 102. Rather, only the retainer arches 40 and 42 are used to hold the seal 100 and the bearing and seal element 102 in place.

Thus, the apparatus 10 may be used with either an offset (C-frame) motor or a symmetrical motor with the only required change being in the impeller housing and the wall above the impeller housing. With an offset motor, such as the motor 80, as illustrated in FIGS. 2 and 3, the impeller housing-60 is coaxially aligned with the offset aperture 32, and the aperture central 34 is sealed.

With a symmetrical motor, the impeller housing 160 of FIG. 6 is coaxially aligned with the central aperture 34, and the offset aperture 32 is sealed. The two retainer arches 40 and 42 are used to secure the seal 100 and the bearing and seal element 102 in place. With the offset motor 80, the seal 100 and bearing and seal element 102 are held in place by the aperture 22 and the retainer arch 42.

In both embodiments the elements 100 and 102 seal the shaft and the upper portion of the impeller housing so that neither air nor water is pulled into or pumped out of the impeller housing through the wall 30. Rather, water flows into the impeller housing only through the single opening in the bottom wall of the impeller housing, and the efficiency of the pump apparatus is accordingly substantially enhanced.

The primary advantage of the apparatus of the present invention is that the water level in the pan of the evaporative cooler in which the pump apparatus is disposed may be substantially reduced. The water level need not cover the top portion 28 of the pump housing in order to prevent air from being drawn into the impeller housing by the shaft, The water level need only be high enough to cover the bottom wall portion 64/164 of the impeller housing, namely the intake aperture 66/166 which extends through the bottom wall 64/164 in order for the pump apparatus of the present invention to function efficiently.

Moreover, with the shaft aperture 32/34 sealed, water is prevented from backing out of the housing 60/160 and from there getting up and onto the bottom side of a pump motor, such as the motor 80.

Figure 7:
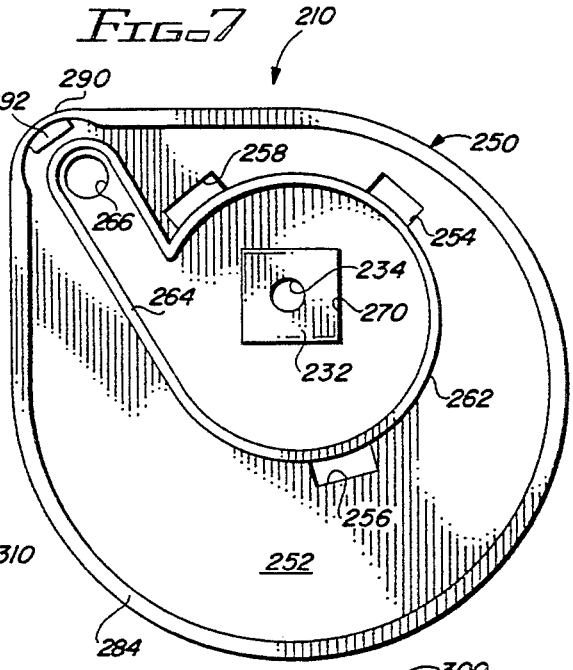
FIG. 7 is a bottom view of a portion of an alternate embodiment of the apparatus of the present invention.

FIG. 7 is a bottom view of alternate embodiment 210 of the evaporative cooler pump apparatus of the present invention. The primary difference between the pump apparatus 210 and the pump apparatus 10 of FIGS. 1–6 is in the configuration of the impeller housing and associated elements. There is also a difference in the apparatus or elements for sealing the impeller shaft 84. FIG. 7 also discloses a different configuration of a bottom portion 250 of the pump apparatus 210. As illustrated in FIG. 1, the configuration of the bottom portion 28 of the pump apparatus 10 is generally circular or round. However, as shown in FIG. 7, the bottom portion 250 is circular for about 270 degrees, and then the bottom portion extends or varies from the circular configuration to an outer portion 290.

Figure 8:
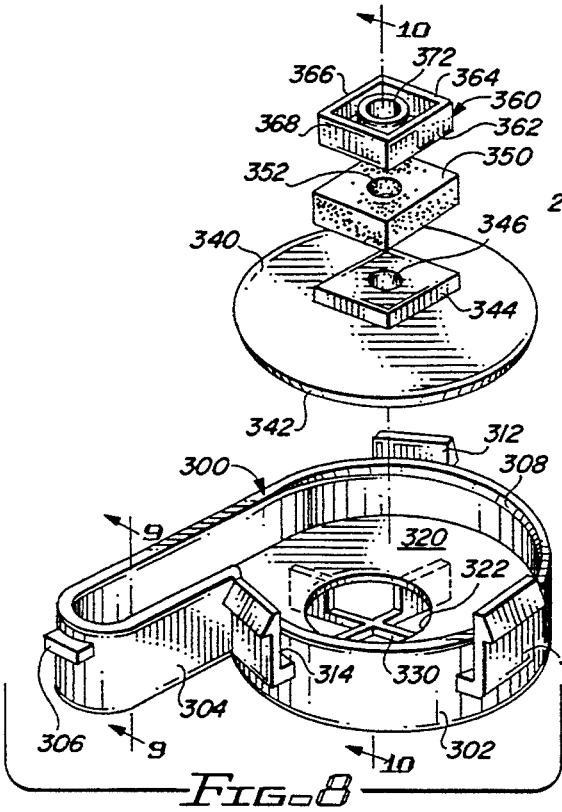
FIG. 8 is an exploded perspective view of elements which comprise other portions of the alternate embodiment of FIG. 7.
Figure 10:
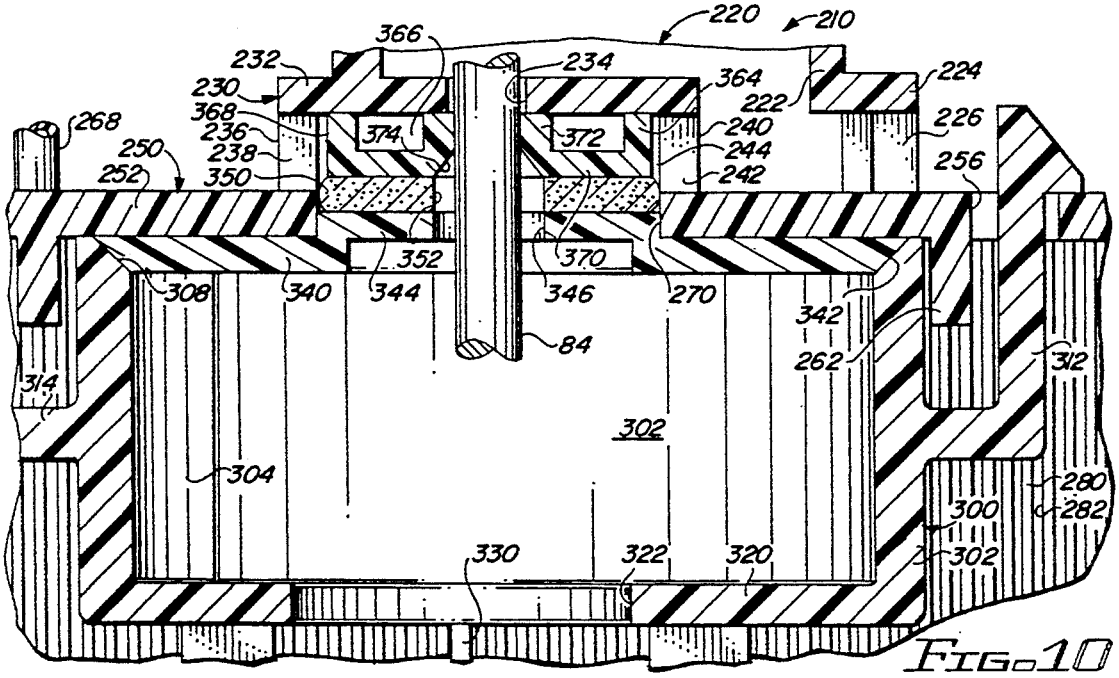
FIG. 10 is an enlarged view in partial section of the elements of FIGS. 7 and 8 secured together.

The pump apparatus 210 also includes elements which matingly engage the bottom portion 250, including an impeller housing 300, shown in FIGS. 8 and 10, and various elements, including seal elements, associated therewith.

Figure 9:
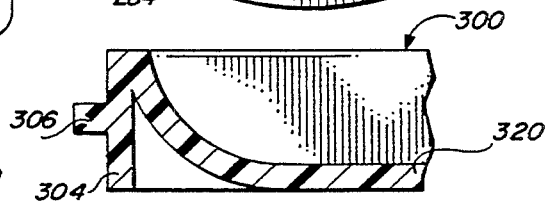
FIG. 9 is a view in partial section taken generally along line 9—9 of FIG. 8.

FIG. 8 comprises an exploded perspective view of the impeller housing 300 and the elements associated with the sealing of the shaft 84 relative to the impeller housing 300 and to the bottom portion 250, as shown in FIG. 7. FIG. 9 comprises a view in partial section of a portion of the impeller housing 300 taken generally along line 9—9 of FIG. 8.

FIG. 10 is an enlarged view in partial section illustrating the securing of the elements of FIG. 8, namely the impeller housing and its associated housing elements, to the bottom 250. Also illustrated in FIG. 10 is a portion of a shaft housing 220 to which the bottom portion 250 is secured. For the following discussion, reference will be made to all four of the FIGS. 7, 8, 9 and 10.

As shown in FIG. 10, the shaft housing 220 includes a wall 222. Outwardly from the wall 222 is a wall 224. The wall 224 includes a generally horizontal portion secured to the wall 222 and a vertical portion secured to the bottom portion 250. The vertical portion of the wall 224 includes a plurality of slots 226 which extend downwardly to the portion 250, and specifically to a horizontal wall 252 of the bottom portion 250.

Diametrically aligned with the wall 224 is a seal housing 230. The seal housing 230 includes a top wall 232 which is disposed generally within the shaft housing 220, but which also extends outwardly therefrom. As shown in FIG. 10, the primarily purpose of the wall portion 224, with its slots 226, is simply to provide symmetry to the apparatus 210 with respect to the portion of the seal housing 230 which extends outwardly from the wall 222.

Extending through the top 232 of the seal housing 230 is a shaft aperture 234. The impeller shaft 84 extends through the aperture 234.

The seal housing 230 is a generally rectangularly configured housing and it includes four sides, three of which are shown in FIG. 10. The three sides include a side 236, a side 240, and a side 244. A plurality of slots 238 extend through the side 236, and a plurality of slots 242 extend through the side 240. The slots 238 and 242 are generally vertically extending slots. The slots 238 and 242 are generally aligned with the slots 226 in the aligned wall element 224.

The bottom portion 250 is secured to the shaft housing 220. The bottom portion 250 includes a horizontal wall 252. The lower or bottom portion of the shaft housing extends upwardly from the horizontal wall 252. That is, the wall 222 terminates at the horizontal wall 252 of the bottom portion 250.

As shown in FIG. 7, there are three holes or apertures 254, 256, and 258 which extend through the horizontal wall 252. As may be inferred from FIG. 10, the three apertures 254, 256, and 258 are disposed outwardly from the housing 220 and its wall 222. The purpose of the apertures 254, 256, and 258 is to receive locking elements for the impeller housing 300, as will be discussed below and as illustrated in FIG. 10.

Extending downwardly from the bottom of the horizontal wall 252 is a generally circular rim portion 262. The circular rim portion 262 comprises a guide for a portion of the impeller housing 300, as will be discussed below. A continuation of the circular rim 262 comprises a trough portion 264. The trough portion 264 also cooperates with a portion of the impeller-housing, as will be discussed below.

Within the rim portion 264 there is an aperture 266 which extends through the horizontal wall 252. The aperture 266 extends to a water outflow tube or outlet spout 268. The outflow tube or spout 268 is shown in FIG. 10. Water pumped from the impeller housing 300 flows through the aperture 266 and outwardly from the pump apparatus 210 through the outflow spout 268.

There is a square aperture 270 which extends through the horizontal wall 252 of the bottom portion 250. The aperture 270 is coaxially aligned, as it were, with the aperture 234 in the top wall 232 of the seal housing 230. The aperture 270 is, of course, disposed within the rims 262 and 264.

As shown in FIG. 10, extending downwardly from the horizontal wall 252 of the bottom portion 250 is an outer wall 280. The outer wall 280 extends downwardly and slopes outwardly, comparable to the slope of the wall 50 of the bottom portion 28, as shown in FIGS. 1 and 2. A plurality of generally vertically extending slots 282 extend through the wall 280. Water flows inwardly to the impeller housing 300 through the slots 282. The slots 282 are relatively narrow and act as strainer elements for preventing debris from flowing into the bottom portion 250 and thence into the impeller housing 300.

A bottom rim 284 (see FIG. 7) extends about the bottom of the outer wall 280. The bottom rim 284 is comparable to the rim 52 on the wall 50, as shown in both FIGS. 1 and 2.

As shown in FIG. 7, the rim 284 narrows down at the peak portion 290 of the bottom portion 250. A recess 292 extends through the outer wall 280 at the peak portion 290. The recess 292 cooperates with a portion of the impeller housing 300 to help secure the impeller housing 300 to the bottom portion 250. This will be explained below.

The impeller housing 300 comprises an insert for the bottom 250. The impeller housing insert 300 is configured generally to conform to the rims 262 and 264 which extend downwardly from the horizontal wall 252 of the bottom portion 250. The impeller housing 300 is best shown in FIG. 8, but details are also shown in FIG. 9 and in FIG. 10.

The impeller housing 300 includes a generally circular wall 302 which has a lesser diameter than the rim 262. The impeller housing 300 accordingly is disposed within the rim 262. The circular wall 302 is joined by a trough wall 304. The trough wall 304 is disposed within the trough portion rim 264. Extending outwardly from the distal end of the trough wall 304 is an extension pin 306. The pin 306 extends into the recess 292 to help hold the impeller housing 300 to the bottom portion 250.

There is a bottom wall 320 which, together with the wall 302 and 304, comprise the impeller housing, or the housing in which the impeller (not shown), but see FIGS. 2, 3, and 6, is actually disposed.

The upper portion of the wall 302 and 304 of the housing 300, remote from the bottom wall 320, include a chamfered lip 308 which extends to the inside of the impeller housing 300. The chamfered lip extends Generally only on the circular wall portion 302. There will be more discussion below on the chamfered lip 308.

Extending outwardly and upwardly from the circular wall 302 are three lock arms. The lock arms include a lock arm 310, a lock arm 312, and a lock arm 314. The lock arms 310, 312, and 314 extend through the lock apertures 254, 256, and 258, respectively, in the wall 252 of the bottom portion 250. It will be noted, as shown both in FIGS. 7 and 10, that the apertures 254 . . . 258 are disposed immediately adjacent to the rim 262. As shown in FIG. 10, the lock arms include an outwardly extending portion and then an upwardly extending portion and a lock tab. The arms 310 . . . 314 extend outwardly from about the midpoint of the vertical height of the wall 302 so as to extend outwardly beyond the rim 262. That is, the rim 262 is disposed between the wall 302 and the upwardly extending portions of the three lock arms 310, 312, and 314.

There is inherent resiliency in the lock arms 310, 312, and 314. They accordingly are easily bent inwardly to allow their top portions to extend through their respective apertures and to move outwardly again so that the locking tabs or flanges on the top of the lock arms is disposed on the top of the wall 252. This is shown in detail in FIG. 10.

Extending through the bottom wall 320 of the impeller housing 300 is an inlet aperture 322. The inlet aperture 322 comprises the only passageway through which water flows into the impeller housing 300.

Antivortex elements 330 extend downwardly from the bottom wall 320 beneath the inlet aperture 322. The antivortex elements 330 interrupt the flow of water so as to prevent vortices from forming.

As shown in FIG. 9, the bottom wall 320 of the impeller housing 300 is generally flat and then it curves upwardly to the top of the rim 304 at the outer end of the trough portion of the housing. Since the outer end of the trough wall 304 communicates with the aperture 266, the curvature of the bottom wall 320 helps to smooth the flow of water of the impeller housing 300, through the aperture 266, and into the outflow tube or outlet spout 268.

A generally circular disk 340 is shown spaced apart from the impeller housing 300 in FIG. 8. In FIG. 10, the disk 340 is shown in place at the top end of the impeller housing 300 and held against the bottom surface of the horizontal wall 252 by the impeller housing 300. The disk 340 includes a chamfered edge 342 which matingly engages the chamfered edge 308 of the circular wall 302. The disk 340 is accordingly essentially sealed to the impeller housing 300 by the mating engagement of the two chamfered edges 308, 342.

Extending upwardly from the disk 340 is a generally square boss 344. The boss 344 extends into the square aperture 270 in the wall 252, as shown in FIG. 10. An aperture 346 extends through the boss 344. The aperture 346 is appropriately aligned with the aperture 234 in the wall 232 of the seal housing 230.

Also shown in FIGS. 8 and 10, above the disk 340 is a foam seal element 350 and a bearing and seal element 360. The foam seal element 350 and the bearing and seal element 360 are shown in FIG. 10 in their use environment. The element 350 is preferably made of closed cell foam as mentioned above, but it may be made of other materials, also. The basic characteristics for the seal element 350 are simply that it be resilient and that it be non-absorptive as far as water is concerned. That is, it will not absorb water.

An aperture 352 extends through the seal element 350. The element 350 is of a generally square configuration.

Above the seal element 350 is the bearing and seal element 360. The bearing and seal element 360 is also of a square configuration. The actual construction of the bearing and seal element 360 may best be understood from both FIGS. 8 and 10.

There are four upwardly extending wall elements to the bearing and seal element 360. They include outer walls 362, 364, 366, and 368. Each wall element is in the configuration of a rectangle, and when they are appropriately secured together the four wall elements define an outer perimeter wall for the element 360. The four wall elements 362 . . . 368 extend upwardly from the outer perimeter of a square bottom 370. Extending upwardly from the bottom 370 is a central cylindrical element 372. The cylindrical element 372 and the bottom 370 include a generally conical aperture or bore 374 extending upwardly through the bottom 370 and through the cylinder 372. As best shown in FIG. 10, the aperture 374 is generally of a conical configuration through the bottom 370 and into the cylinder 372. The upper portion of the aperture or bore 374 is generally cylindrical and has a diameter which is substantially the same as the diameter of the shaft 84.

As best shown in FIG. 10, the overall dimensions of the bearing and seal element 360 is slightly less than the inside distance between the four walls of the seal housing 230. This allows the bearing and seal element 360 to essentially float in response to eccentric motion of the shaft 84, should such occur. The diameter of the aperture 352 in the flexible seal element 350 is slightly larger than the outer diameter of the shaft 84. The overall height of the bearing seal element 360 and the foam element 350 in its original form is greater than the distance between the upper surface of the boss 344 of the disk 340 to the bottom of the top wall 232 of the housing 230. Accordingly, when the disk 340 is in place, beneath the foam element 350 and the bearing and seal element 360, as shown in FIG. 10, and with the disk 340 held in place by the impeller housing 300, the foam element 350 is squeezed or compressed to a lesser height than its original height. The squeezing or compressing of the foam element 350 provides a bias against the bearing and seal element 360 to hold the bearing and seal element 360 against the bottom surface of the top 232 of the seal housing 230. The inherent resiliency of the element 350 allows it to compress and to provide the bias.

It will be noted, as shown in FIG. 10, that the diameter of the aperture 346 in the boss 344 of the disk 340 is larger than the outer diameter of the shaft 84. The shaft 84 accordingly may move in an eccentric path, or whatever, without contacting the disk 340. Similarly, the diameter of the aperture 234 in the top 232 of the housing 230 is greater than the diameter of the shaft 84 for the same reason as given above. There accordingly is no constraint to the eccentric movement of the shaft 84 with respect to the housing 230, the bottom portion 250 of the pump apparatus, or the impeller housing 300 and the disk 340. On the other hand, the seal and bearing element 360 provides a seal for the shaft 84, together with the seal element 350, to prevent water flowing downwardly into the impeller housing 300. When the bias of the disk 340 is impressed against the seal 350, it deforms both in height and in its outer dimensions so as to form a seal with the housing 230 and the disk 340 to prevent the flow of water downwardly into the impeller housing 300. The seal element 350 provides a seal between the bearing seal element 360 and the disk 340 to prevent water and air from entering or exiting the impeller housing 300 except through the aperture 322 and the outflow spout 268. The disk 340 is sealed to the housing 300 by the chamfered structures 308, 342.

As indicated above, water flows into the impeller housing 300 only through the aperture 322. With only a single entryway for the water to flow into the impeller housing 300, it will be understood that the pump apparatus 210, like the pump apparatus, 10 will operate in water, the depth of which may be substantially lower than the height of the top or horizontal wall 252 of the bottom portion 250 of the pump 210. No air will come into the impeller housing 300 along the shaft 84, and no water will flow out of the housing 300 along the shaft 84. Accordingly, maximum efficiency of the pump 210 will be attained since water flows into the housing 300 only through the aperture 322 and out of the housing 300 only through the aperture 266 and the outflow spout 268.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Pump apparatus for an evaporative cooler, comprising, in combination:

a pump motor;

a motor shaft rotatable by the pump motor and extending downwardly from the pump motor;

motor housing means for receiving the pump motor;

shaft housing means for receiving the motor shaft and extending downwardly from the motor housing means;

bottom housing means secured to the shaft housing means, including a generally horizontal wall secured to the shaft housing means remote from the motor housing means, an aperture in the generally horizontal wall through which the motor shaft extends, an impeller housing extending downwardly from and secured to the generally horizontal wall about the aperture, a bottom wall on the impeller housing, an intake aperture extending through the bottom wall through which water flows into the impeller housing, and outlet means through which water is pumped out of the impeller housing;

an impeller disposed in the impeller housing and secured to the motor shaft for pumping water out of the impeller housing through the outlet means; and means for sealing the aperture in the generally horizontal wall and the motor shaft extending therethrough to prevent water from flowing out of the impeller housing through the aperture and from preventing air and water from flowing into the impeller housing through the aperture to insure that the intake aperture comprises a single inlet for the impeller housing through which the water flows into the impeller housing and that the outlet means comprises a single outlet through which water is pumped out of the impeller housing, including a flexible seal through which the motor shaft extends and which seal is movable with any eccentricity of the motor shaft.

2. The apparatus of claim 1 in which the flexible seal comprises a closed cell foam element.

3. The apparatus of claim 1 in which the means for sealing the aperture in the generally horizontal wall and the motor shaft further includes a relatively solid seal and bearing element disposed against the flexible seal.

4. The apparatus of claim 3 in which the means for sealing the aperture in the generally horizontal wall and the motor shaft include means for retaining the flexible seal and the relatively solid seal and bearing element on the generally horizontal wall.

5. The apparatus of claim 4 in which the means for retaining the flexible seal and the relatively solid seal and bearing element on the generally horizontal wall includes a pair of arch elements on the generally horizontal wall, and the flexible seal and the relatively solid seal and bearing element are disposed beneath the pair of arch elements.

6. The apparatus of claim 4 in which the means for retaining the flexible seal and the relatively solid seal and bearing element on the generally horizontal wall includes an arch element on the generally horizontal wall and an aperture in the shaft housing means, and the flexible seal and the relatively solid seal and bearing element are disposed beneath the arch element and in the aperture in the shaft housing means.

7. The apparatus of claim 1 in which the bottom housing means further includes a bottom support wall extending generally downwardly from the generally horizontal wall and below the bottom wall of the impeller housing for supporting the motor housing means, the shaft housing means, and the bottom housing means.

8. The apparatus of claim 7 in which the bottom housing means further includes a plurality of strainer slots extending through the bottom support wall through which water flows to the intake aperture of the impeller housing and which prevent debris from entering into the impeller housing.

9. The apparatus of claim 1 in which the motor housing means includes a motor housing in which the pump motor is disposed and a cap covering the motor housing.

10. The apparatus of claim 9 in which the motor housing means further includes vent apertures through which air for cooling the motor flows into the motor housing and upwardly over the motor.

11. The apparatus of claim 10 in which the cap of the motor housing means is spaced apart from the motor housing to allow the cooling air to flow into the cap and out of the cap between the cap and the motor housing.

12. The apparatus of claim 1 in which the bottom housing means further includes a seal housing disposed about the aperture in the generally horizontal wall for receiving the means for sealing the aperture, and a disk disposed against the means for sealing the aperture and against the generally horizontal wall.

13. The apparatus of claim 12 in which the impeller housing includes a lip disposed against the disk to secure the disk against the generally horizontal wall and against the means for sealing the aperture.

14. The apparatus of claim 12 in which the means for sealing the aperture include a relatively solid bearing and seal element disposed in the seal housing, and a flexible seal element disposed between the relatively solid bearing and seal element and the disk.

15. The apparatus of claim 14 in which the aperture in the generally horizontal wall is generally square.

16. The apparatus of claim 14 in which the seal housing is generally square, and the relatively solid bearing and seal element and the flexible seal element are generally square.

17. The apparatus of claim 16 in which the disk of the bottom housing means includes a generally square boss extending into the generally square aperture and against the generally square seal element.

18. Evaporative cooler pump apparatus, comprising, in combination:

pump motor;

pump housing means for housing the pump motor;

an impeller remote from the pump motor rotatable for pumping water;

a shaft secured to the impeller and to the motor for rotating the impeller;

bottom housing means disposed about the impeller and secured to the pump housing means, including a top wall, an impeller housing secured to the top wall and disposed about the impeller, a bottom wall secured to the impeller housing remote from the top wall, a first hole in the top wall through which the shaft extends, a second hole in the bottom wall through which water flows into the impeller housing, and an outlet through which water is pumped out of the impeller housing; and means for sealing the first hole in the top wall about the shaft to prevent water and air from flowing into the impeller housing and to prevent water from flowing out of the impeller housing through the first hole and to insure that the second hole in the bottom wall comprises a single water inlet for the bottom housing means, including a flexible seal element through which the shaft extends.

19. The apparatus of claim 18 in which the flexible seal element is disposed on the top wall.

20. The apparatus of claim 18 in which the flexible seal element comprises closed cell foam.

21. The apparatus of claim 18 in which the means for sealing the first hole in the top wall about the shaft further includes a bearing and seal element disposed against the flexible seal element.

22. The apparatus of claim 21 in which the bearing and seal element is movable on the flexible seal element.

23. The apparatus of claim 21 in which the means for sealing the first hole in the top wall further includes means for securing the flexible seal element and the bearing and seal element on the top wall.

24. The apparatus of claim 18 in which the pump housing means includes a motor housing for the pump motor, and a shaft housing extending between and secured to the motor housing and to the housing means disposed about the impeller.

25. The apparatus of claim 24 in which the housing means disposed about the impeller further includes a sloping wall extending downwardly from the top wall and about the impeller housing.

26. The apparatus of claim 25 in which the housing means disposed about the impeller further includes a plurality of strainer slots in the sloping wall through which water flows.

27. The apparatus of claim 18 in which the bottom housing means further includes a seal housing, and the shaft extends through the seal housing and the means for sealing the first hole in the top wall is disposed in the seal housing.

28. The apparatus of claim 27 in which the bottom housing means further includes a disk disposed against the top wall and against the means for sealing the first hole in the top wall for securing the means for sealing the first hole in the seal housing.

29. The apparatus of claim 28 in which the disk is disposed between the top wall and the impeller housing.

30. The apparatus of claim 28 in which the means for sealing the first hole includes a generally inflexible bearing and seal element disposed in the seal housing and the flexible seal element disposed between the bearing and seal element and the disk.

* * * * *